US006881092B2

(12) United States Patent
Ke et al.

(10) Patent No.: US 6,881,092 B2
(45) Date of Patent: Apr. 19, 2005

(54) CABLE END CONNECTOR ASSEMBLY HAVING PULL MECHANISM

(75) Inventors: Yun Long Ke, Tu-Chen (TW); Chin Pao Kuo, Tu-Chen (TW); Shih Tung Chang, Tu-chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/633,192

(22) Filed: Jul. 31, 2003

(65) Prior Publication Data

US 2004/0242050 A1 Dec. 2, 2004

(30) Foreign Application Priority Data

May 28, 2003 (TW) ..... 92209840

(51) Int. Cl.[7] ..... H01R 13/00
(52) U.S. Cl. ..... 439/483
(58) Field of Search ..... 439/483, 484, 439/152

(56) References Cited

U.S. PATENT DOCUMENTS

| | | | | |
|---|---|---|---|---|
| 4,379,361 A | | 4/1983 | Webster et al. | |
| 5,446,622 A | * | 8/1995 | Landry et al. | 361/737 |
| 6,126,479 A | * | 10/2000 | Lee | 439/484 |
| 6,416,353 B1 | | 7/2002 | Hwang et al. | |

* cited by examiner

*Primary Examiner*—Phuong Dinh
(74) *Attorney, Agent, or Firm*—Wei Te Chung

(57) ABSTRACT

A cable end connector assembly (1) includes an insulative housing (10), a number of contacts (20), a number of wires (30), a shell (40, 50), a bridge portion (615), and a pull tab (62). The insulative housing includes a number of passageways (11). The contacts are received in the passageways of the insulative housing. The wires are electrically connected with the contacts. The shell is assembled to the insulative housing. The bridge portion projects outside the shell. The pull tab is fixed to the bridge portion.

3 Claims, 7 Drawing Sheets

CABLE END CONNECTOR ASSEMBLY HAVING PULL MECHANISM

BACKGROUND OF THE INVENTION

1. Field of the Invention

The present invention relates to an electrical connector assembly, and particularly to a cable end connector assembly having a pull mechanism to facilitate disengaging the cable end connector assembly from a mating complementary connector.

2. Description of Prior Art

There exists in the art a cable end connector assembly matable with an electrical connector mounted on a printed circuit board for transmitting signals therebetween. To facilitate removing the cable end connector assembly from connection with the complementary connector, pull mechanisms have been used. Such pull mechanisms generally permit applying a withdrawing force to the cable end connector assembly without directly pulling a cable of the cable end connector assembly.

U.S. Pat. No. 4,379,361 discloses one type of pull mechanism. A cable end connector assembly disclosed therein has a pull tab partially inserted in a connector body of the assembly between two rows of contacts of the assembly for user pinching and pulling when the assembly is to be disengaged from a complementary connector. However, to comply with miniaturization trends in the electronic field, the cable end connector assembly is required to be manufactured much smaller than before, and the contacts of the assembly are arranged much closer than before. Therefore, there will be no enough room inside the connector body to accommodate the pull tab. In addition, since the pull tab is fixed in the connector body, when it is damaged in usage, the connector body has to be taken apart to replace the pull tab, which is obviously undesirable to users.

U.S. Pat. No. 6,416,353 discloses another type of pull mechanism. A cable end connector assembly disclosed therein has a pull mechanism assembled outside of an elongated housing thereof. The insulative housing is formed with a pair of locking structures at opposite ends thereof. The pull mechanism comprises an arch pull leash and a pair of locking tabs engageable with the pull leash and the locking structures of the insulative housing. Thus, the assembly can be disengaged from a complementary connector readily by pulling the pull leash. Whereas, such pull mechanism and locking structure are not adapted for a miniature cable end connector assembly, because the sizes of the pull mechanism and the locking structure are required to be much smaller to correspond to the miniature connector assembly, which will make the configurations of the pull mechanism and the locking structure become quite complicated comparing with they being in original sizes. Therefore, a mass of trouble will be encountered in manufacturing and assembling the pull mechanism and the locking structure.

Co-pending U.S. patent application Ser. Nos. 10/406105, now U.S. Pat. No. 6,705,885, Ser. No. 10/406691, now U.S. Pat. No. 6,786,759, and Ser. No. 10/406052, now U.S. Pat. No. 6,783,387, commonly assigned to the same assignee and filed on Apr. 2, 2003, disclose some approaches. However, some other solutions applicable for some special circumstances are still needed.

Hence, an improved cable end connector assembly is required to overcome the disadvantages of the prior art.

SUMMARY OF THE INVENTION

A major object of the present invention is to provide a cable end connector assembly with a pull mechanism facilitating manufacturing and assembling thereof.

In order to achieve the object set forth, a cable end connector assembly comprises an insulative housing, a plurality of contacts, a plurality of wires, a shell, a bridge portion, and a pull tab. The insulative housing comprises a plurality of passageways. The contacts are received in the passageways of the insulative housing. The wires are electrically connected with the contacts. The shell is assembled to the insulative housing. The bridge portion projects outside the shell from either the shell or a mounting member assembled to the shell. The pull tab is fixed to the bridge portion.

Other objects, advantages and novel features of the invention will become more apparent from the following detailed description when taken in conjunction with the accompanying drawings.

DETAILED DESCRIPTION OF THE INVENTION

Figure 1:
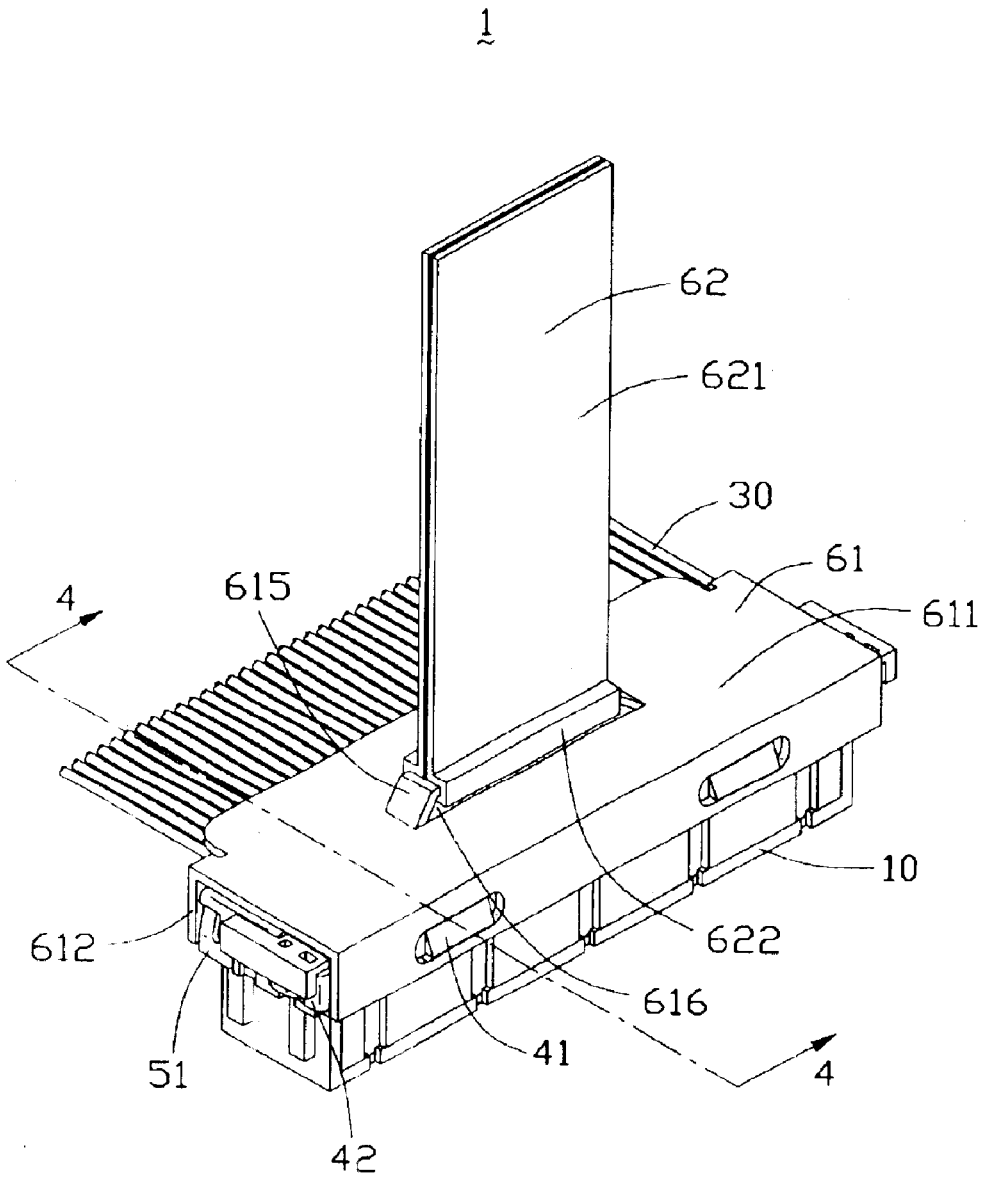
FIG. 1 is a perspective view of a cable end connector assembly in accordance with a first embodiment of the present invention.

Referring to FIGS. 1, 2, 4 and 6, a cable end connector assembly 1 in accordance with a first embodiment of the present invention comprises an elongated insulative housing 10, a plurality of contacts 20, a plurality of wires 30, a first and a second shell halves 40, 50, and a pull mechanism 60.

Figure 2:
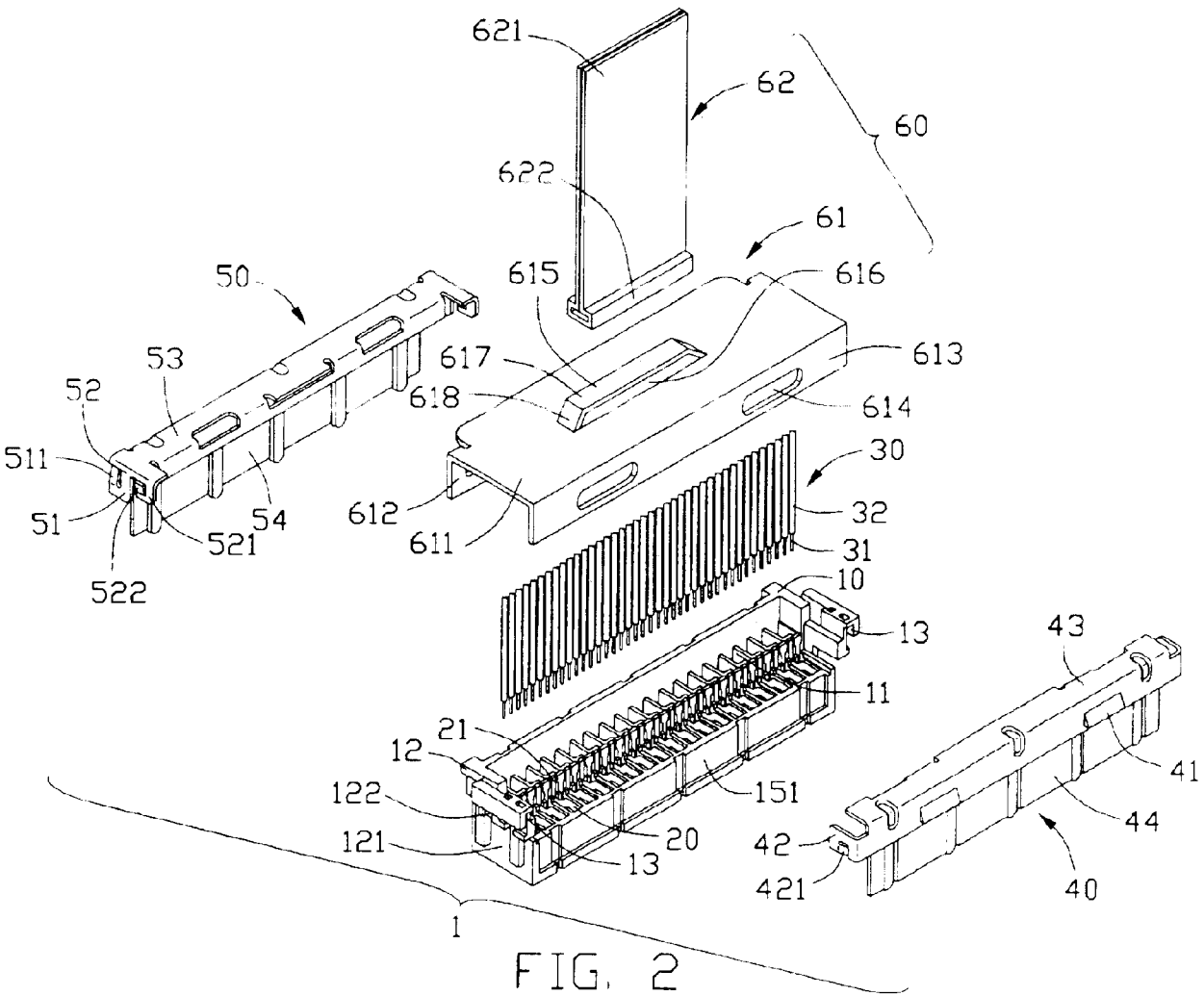
FIG. 2 is an exploded perspective view of the cable end connector assembly of FIG. 1.

Referring to FIG. 2, the insulative housing 10 includes two end walls 121, a front and a rear walls 151, 152 (see FIG. 4) connecting to the end walls 121, and a bottom wall 16 (see FIG. 6) connecting to the end, the front, and the rear walls 121, 151, 152. The insulative housing 10 defines a plurality of passageways 11 therein and a plurality of apertures 14 (see FIG. 6) communicating with corresponding passageways 11 in the bottom wall 16 for receiving contacts of a complementary connector (not shown). Each end wall 121 comprises a groove 13 at a front end thereof, a first step portion 131 (see FIG. 5) formed thereon, a second step portion 12 at rear end thereof and a slot 122 between the first step portion 131 and the second step portion 12.

Each contact 20 includes a contacting portion 22 (see FIG. 4) received in corresponding passageway 11 of the insulative housing 10 and a tail portion 21 extending from the contacting portion 22.

Each wire 30 includes a conductor 31 electrically connected with the tail portion 21 of each contact 20 and an insulator 32 enclosing the conductor 31.

The first and the second shell halves 40, 50 have a similar configuration. Each shell half 40 (50) includes an elongated right-angle main portion 43 (53) and an abutting portion 44 (54) extending downwardly from the main portion 43 (53). Each main portion 43 (53) includes a horizontal portion 431 (531) (see FIG. 4) and a vertical portion 432 (532) (sec FIG. 4) perpendicular to the horizontal portion 431 (531). The main portion 43 of the first shell half 40 further comprises two wedge-shaped projections 41 projecting forwardly from the vertical portion 432 thereof and a pair of first engaging portions 42 extending rearwardly from opposite lower ends of the vertical portion 432. The main portion 53 of the second shell half 50 comprises a pair of second engaging portion 52 extending downwardly from opposite ends of the horizontal portion 531 thereof. Each first engaging portion 42 is formed with a first tab 421 extending sidewardly at distal end thereof. Each second engaging portion 52 includes a front section 521 and a rear section 51. The front section 521 is formed with a wedge-shaped protrusion 522 projecting therefrom. The rear section 51 comprises a second tab 511 extending sidewardly at distal end thereof.

Figure 3:
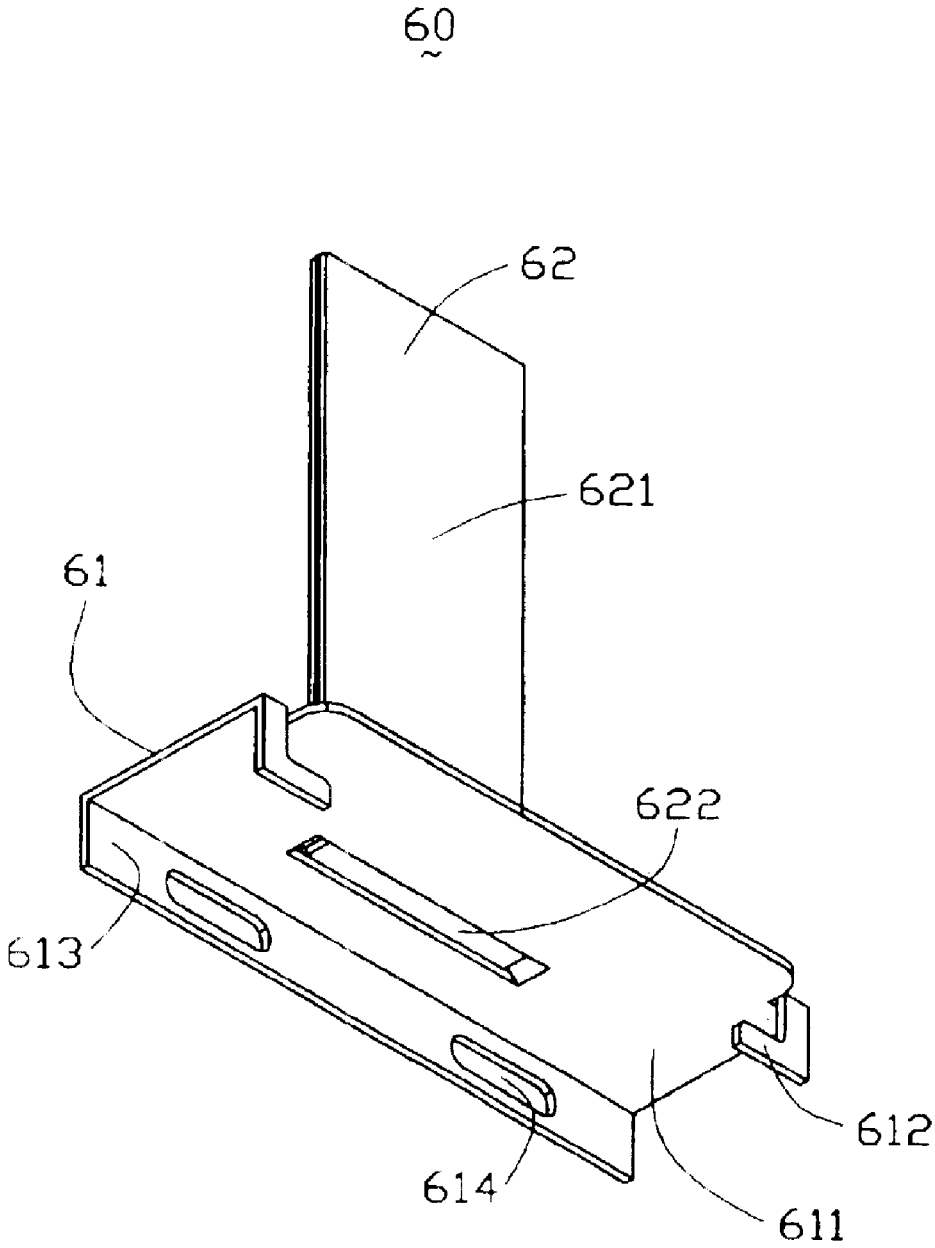
FIG. 3 is a perspective view of a pull mechanism of the cable end connector assembly of FIG. 2 from a different aspect.

In conjunction with FIG 3, the pull mechanism 60 includes a mounting member 61 and a pull tab 62. The mounting member 61 is stamped from a metallic sheet and includes a plate forming a base portion 611 with an upper face thereon (not labeled), a connecting portion 613 extending downwardly from one side of the base portion 611, a pair of L-shaped legs 612 extending downwardly from opposite ends of the other side of the base portion 611, a bridge portion 615 stamped upwardly from the base portion 611, and a space 616 defined between the bridge portion 615 and the base portion 611. The connecting portion 613 defines two openings 614 therein. The bridge portion 615 is generally located at a middle section and structured along an elongated direction of the base portion 611. The bridge portion 615 has two opposite incline sections 618 obliquely projecting from the base portion 611 and a retaining bar 617 connecting the incline sections 618 and being parallel to the base portion 611. The space 616 is located below the retaining bar 617 and above a plane where the base portion 611 positioned. The pull tab 62 is made of plastic or plastic-like sheet material.

In assembly, the pull tab 62 passes through the space 616 and then is overlapped to form a receiving portion 622 receiving the retaining bar 617 and a pull portion 621 at end thereof for being pinched by user.

Figure 4:
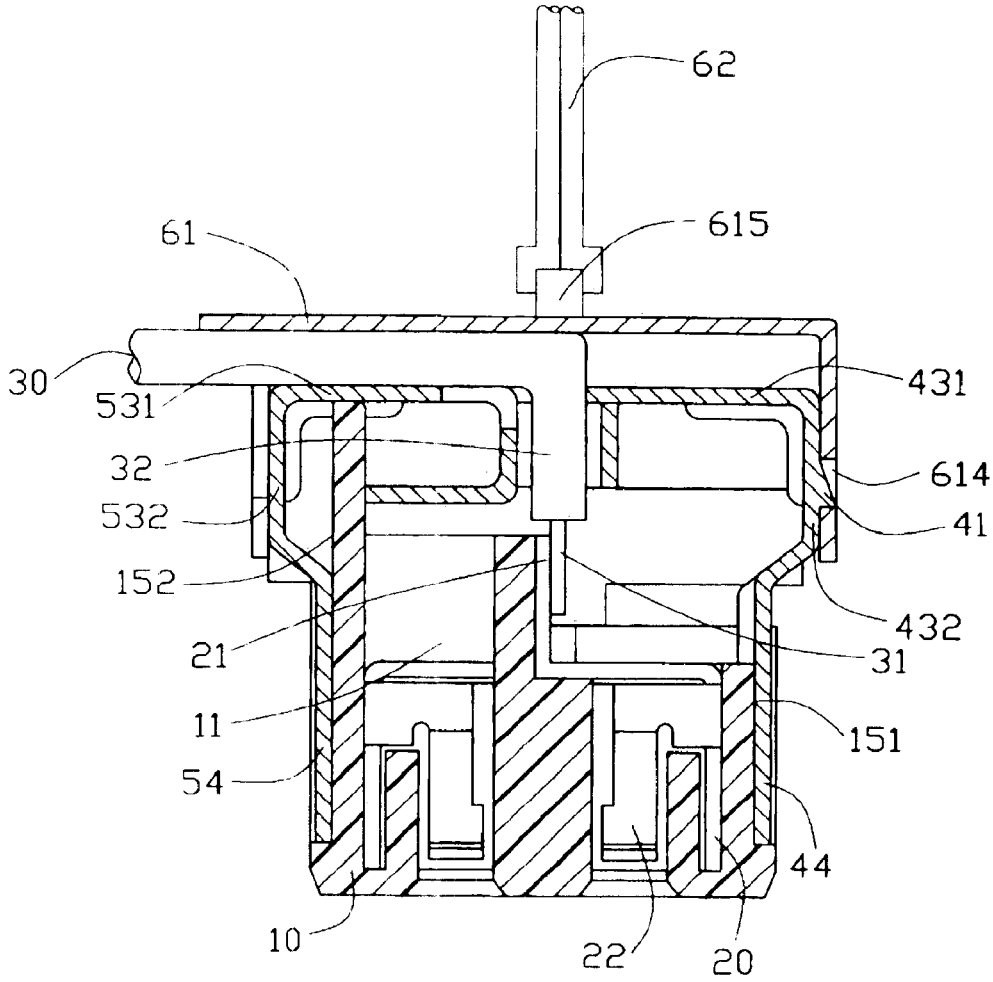
FIG. 4 is a cross-sectional view taken along line 4—4 of FIG. 1.
Figure 5:
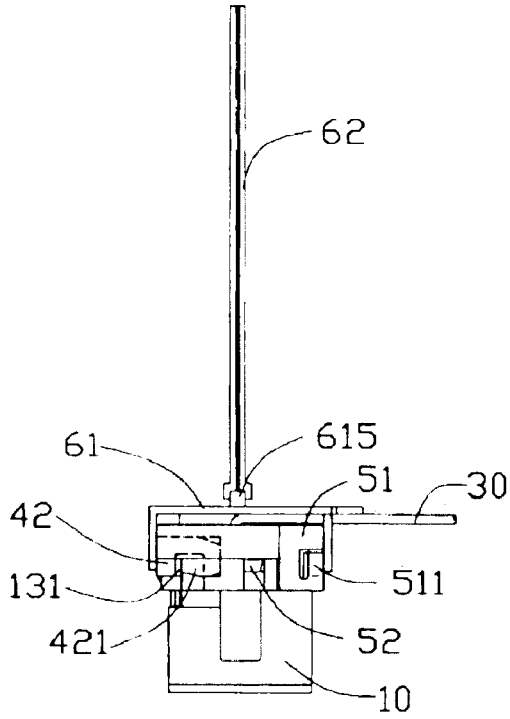
FIG. 5 is a side view of the cable end connector assembly of FIG. 1.
Figure 6:
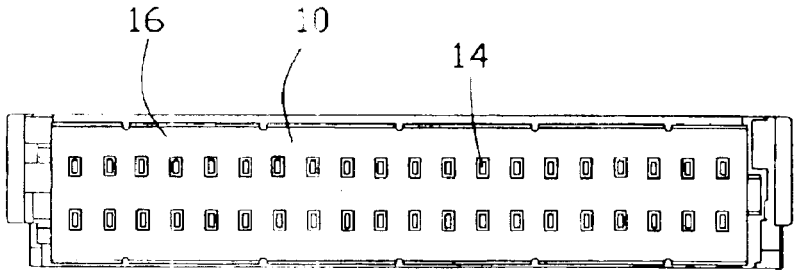
FIG. 6 is a bottom view of the cable end connector assembly of FIG. 1, wherein a plurality of wires of the cable end connector assembly are not shown.

Referring to FIGS. 2, 4 and 5, the contacts 20 are received in the passageways 11 of the insulative housing 10, and the wires 30 are electrically connected to the contacts 20 with the conductors 31 of the wire 30 being soldered to the tail portions 21 of corresponding contacts 20. The first shell half 40 is assembled to the insulative housing 10 along a front-to-rear direction. The first engaging portions 42 are inserted into the groove 13 with the first tab 421 engaging with the first step portion 131. The abutting portion 44 abuts against the front wall 151 of the insulative housing 10. The second shell half 50 is assembled to the insulative housing along a top-to-bottom direction. The front section 521 of the second engaging portion 52 is inserted into the slot 122 of the insulative housing 10 with the protrusion 522 abutting against the insulative housing at a bottom face of the slot 122. The second tab 511 of the rear section 51 of the second engaging portion 52 engages with the second step portion 12, and the abutting portion 54 of the second shell half 50 abuts against the rear wall 152 of the insulative housing 10.

At this time, the wires 30 extend upwardly from a position between the first and second shell halves 40, 50 parallel to a direction along which the complementary connector mates with the assembly 1. The projections 41 of the first shell half 40 are received in the openings 614 of connecting plate 613. The legs 615 of the mounting member 61 are soldered to the second shell half 50, and the wires 30 extend through the space between the two legs 614. By this way, the pull mechanism 60 is readily and securely attached to the shell 40, 50.

When the cable end connector assembly 1 needs to be removed from the complementary connector, the pull portion 621 of the pull tab 62 is pulled upwardly. The pull force is then transmitted to the mounting member 61 by the engagement between the receiving portion 622 of the pull tab 62 and the retaining bar 617 of the bridge portion 615. The pull force is finally transmitted to the whole assembly 1 by the engagement between the mounting member 61 and the shell 40, 50, thereby the assembly 1 being disengaged from the complementary connector.

Clearly, since the bridge portion 615 is exposed outside, the pull tab 62 can also be fixed to the retaining bar 617 of the bridge portion until the mounting member 61 is assembled to the shell 40, 50. When the pull tab 62 is damaged, it is quite easy to replace the pull tab without tacking apart the assembly 1.

Figure 7:
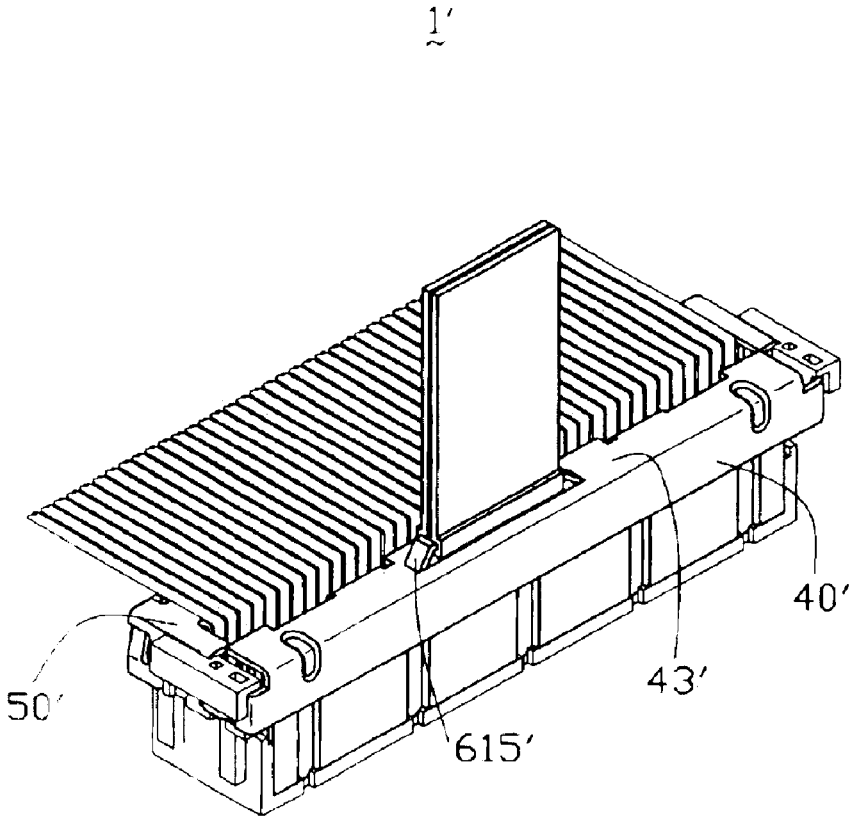
FIG. 7 is a perspective view of a cable end connector assembly of a second embodiment of the present invention.
Figure 8:
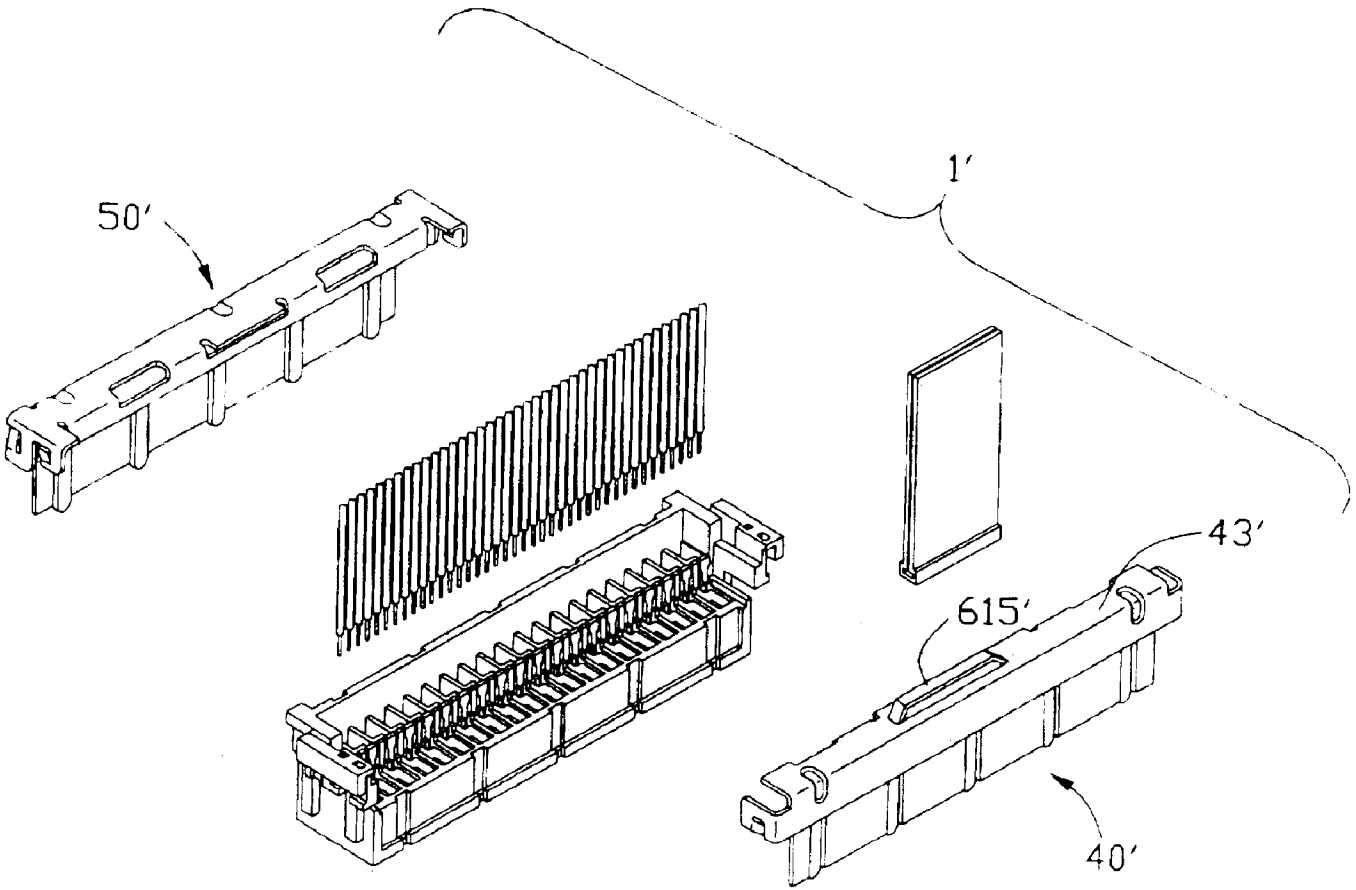
FIG. 8 is an exploded perspective view of the cable end connector assembly of FIG. 7.

FIGS. 7 and 8 show a cable end connector assembly 1' of a second embodiment of the present invention. The main differences distinguished from the above embodiment is that the mounting member 61 of the above embodiment is unnecessary here and the bridge portion 615' is stampeded from the main portion 43' of the first shell half 40' (also may be stamped from the second shell half 50' if required) instead of from the mounting member in the above embodiment. Such configuration can get the same effects as obtained by the above embodiment.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable end connector assembly comprising:

an insulative housing comprising a plurality of passageways;

a plurality of contacts received in the passageways of the insulative housing;

a plurality of wires electrically connected with the contacts;

a shell assembled to the insulative housing;

a bridge portion projecting outside the shell; and a pull tab fixed to the bridge portion; wherein the shell comprises a base portion and the bridge portion is integrally stamped from the base portion; wherein the bridge portion comprises a pair of incline sections projecting from the base portion and a retaining bar connecting the two incline sections; wherein a space is defined below the retaining bar and above a plane where the base portion lies for allowing the pull tab to extend therethrough; wherein the pull tab comprises a receiving portion receiving the retaining bar and a pull portion extending from the receiving portion for being pulled; wherein the shell comprises a first and a second shell halves, and wherein the bridge portion is formed on the first shell half; wherein the wires extend from a position between the first and the second shell halves and then perpendicular to a direction along which the passageways of the insulative housing extend.

2. A cable end connector assembly comprising:

an insulative housing;

a plurality of contacts disposed in the housing;

a plurality of wires mechanically and electrically connected to the corresponding contacts, respectively;

a mounting member attachably positioned on the housing around said wires, with an upward face provided thereon;

a bridge portion upwardly raised above said upward face with a tiny gap thereabouts; and a pull tab extending through said gap and fixed to said bridge portion and extending away from said upward face; wherein a horizontal dimensions of said bridge portion are relatively smaller than those of the upward face so as to allow a relatively small joint provided between the pull tab and the mounting member; wherein the mounting member comprises a base portion and the bridge portion is integrally stamped from the base portion; wherein the bridge portion comprises a pair of incline sections projecting from the base portion and a retaining bar connecting the two incline sections; wherein a space is defined below the retaining bar and above a plane where the base portion lies for allowing the pull tab to extend therethrough; wherein the pull tab comprises a receiving portion receiving the retaining bar and a pull portion extending from the receiving portion for being pulled.

3. The assembly as claimed in claim 2, wherein said mounting member is either directly mounted to the housing, or indirectly through a shell which is directly mounted to the housing.

* * * * *